US007856994B2

(12) United States Patent
Rebours

(10) Patent No.: US 7,856,994 B2
(45) **Date of Patent: *Dec. 28, 2010**

(54) MASCARA BRUSH

(75) Inventor: Christophe Rebours, Suresnes (FR)

(73) Assignee: Amorepacific Corporation, Seoul (KR)

( * ) Notice: Subject to any disclaimer, the term of this patent is extended or adjusted under 35 U.S.C. 154(b) by 197 days.

This patent is subject to a terminal disclaimer.

(21) Appl. No.: 11/815,595

(22) PCT Filed: Mar. 2, 2006

(86) PCT No.: PCT/KR2006/000715

§ 371 (c)(1),
(2), (4) Date: Aug. 6, 2007

(87) PCT Pub. No.: WO2006/095974

PCT Pub. Date: Sep. 14, 2006

(65) Prior Publication Data

US 2008/0149127 A1 Jun. 26, 2008

(30) Foreign Application Priority Data

Mar. 8, 2005 (KR) ..... 20-2005-000261 U

(51) Int. Cl.
*A45D 40/26* (2006.01)

(52) U.S. Cl. ..... 132/218

(58) Field of Classification Search ..... 132/218, 132/317, 320; 401/126, 129, 130, 122
See application file for complete search history.

(56) References Cited

U.S. PATENT DOCUMENTS 4,527,575 A * 7/1985 Vasas ..... 132/218
6,591,842 B2 * 7/2003 Gueret ..... 132/218

* cited by examiner

*Primary Examiner*—Robyn Doan
(74) *Attorney, Agent, or Firm*—John K. Park; Park Law Firm

(57) ABSTRACT

Provided is a disk-type mascara brush, used to makeup eyelash with mascara solution applied thereto, having a brush portion which is formed whole at the end of the wand and in a such a shape that elliptic disks are piled consecutively at a constant angle around a point In a disk-type mascara brush where the brush portion is formed in such a shape that disks are piled at the end of the wand 2, the mascara brush has a brush portion which is formed whole and in such a shape that disk-type plate-tooth are piled consecutively at an constant angle around a point.

4 Claims, 5 Drawing Sheets

[Fig. 1] PRIOR ART
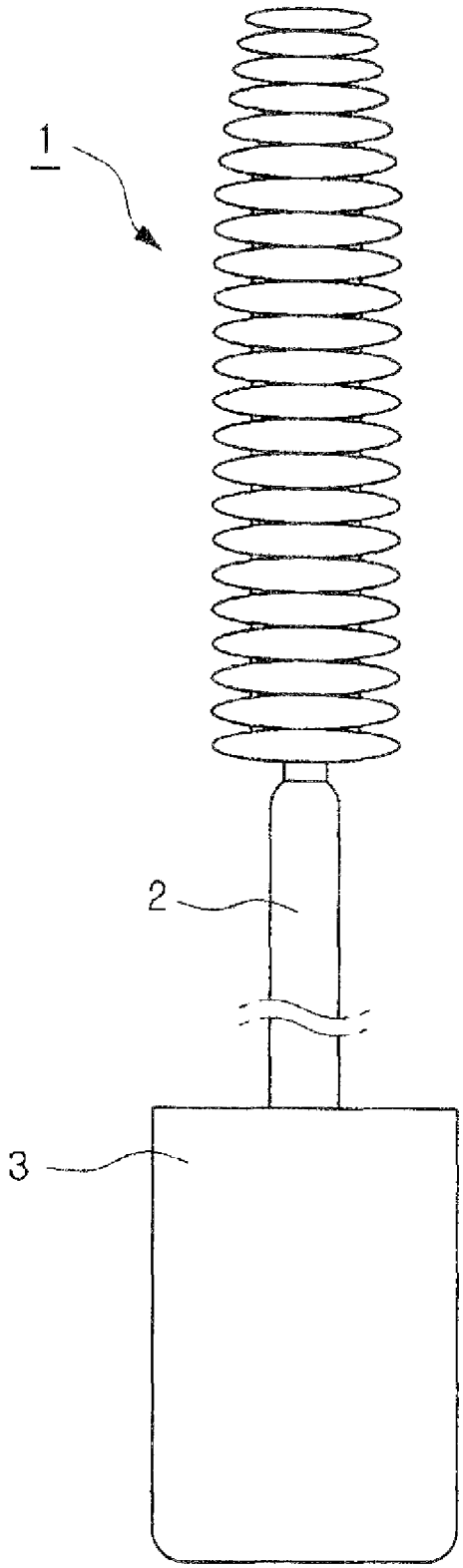

[Fig. 2]
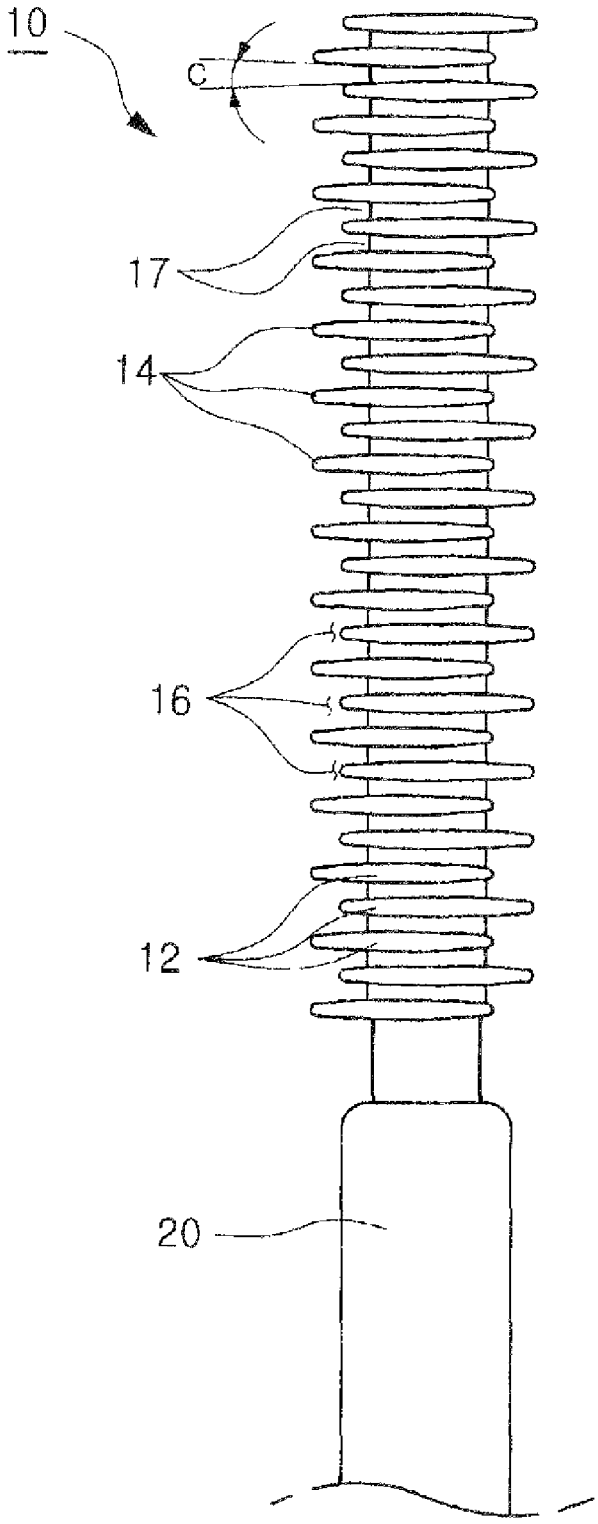

[Fig. 3]
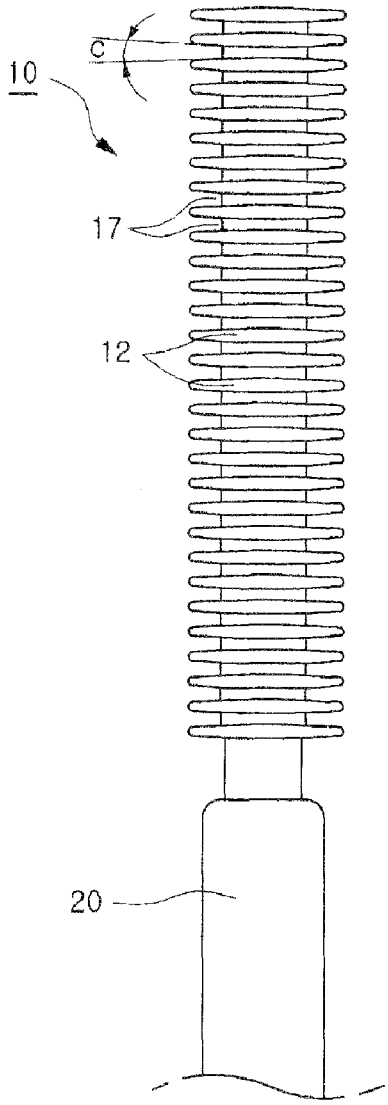
[Fig. 4]
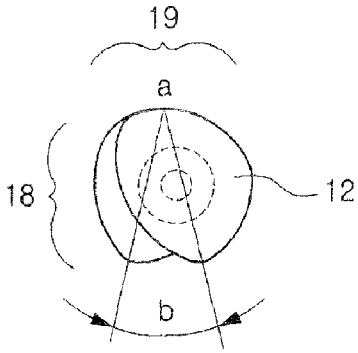

[Fig. 5]
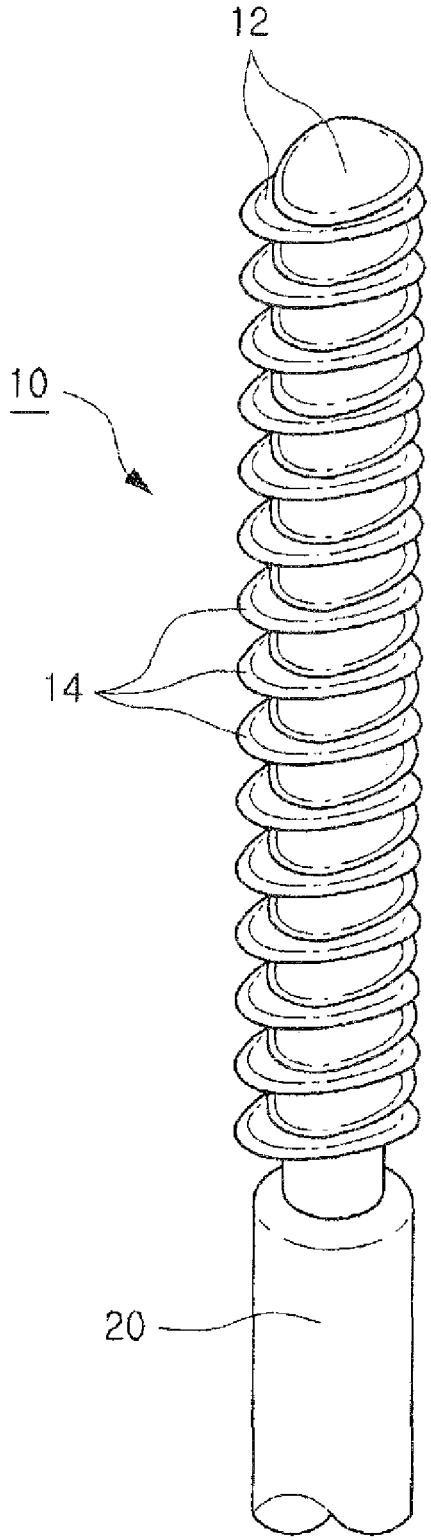

[Fig. 6]
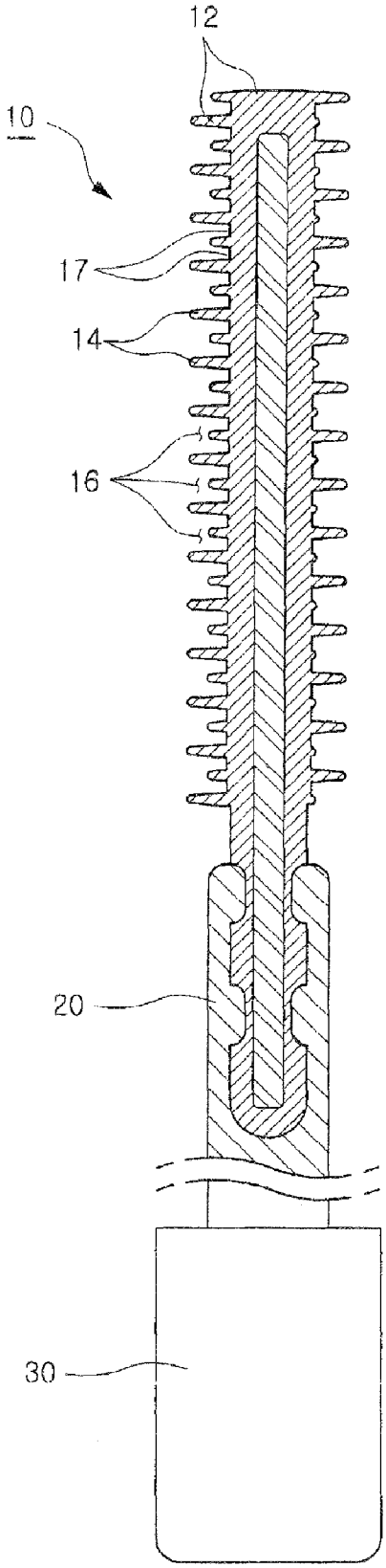

MASCARA BRUSH

TECHNICAL FIELD

The present invention relates to a mascara brush which is used for performing makeup of eyelash with mascara solution applied thereto, and more particularly, relates to a disk-type mascara whose brush portion is formed whole at the end of a wand and in such a shape that triangle-like elliptic disks are piled consecutively with an alternated arrangement at a constant angle like an unfolded fan around a point.

BACKGROUND ART

Generally, mascara is comprised of a case for containing mascara solution with a constant viscosity and a tone of color, a mascara brush for applying the mascara solution contained in the case to eyelash and a cap assembled to the mascara brush.

There are two kinds of conventional mascara brushes; a bristle-brush twisted from two wires with plastic bristles and a disk-type mascara brush where a brush portion is formed at the end of a wand as if pluralities of disks are piled consecutively.

Because the conventional bristle-brush is made by plastic bristles twisted with wires, its process is so complex that productivity is low and there are difficulties in maintaining constant quality of the brush. Although the disk-type brush that is made by plastic or rubber whole, as disclosed in Japan patent application No. 1988-85113, U.S. Laid-upon Pat. No. 6,591,842 and Korean Laid-upon patent No. 2002-0095157, is productive and easy to maintain quality, it is hardly capable to comb eyelash up than the bristle-brush, so that it does not widely spread to the Eastern people whose eyelash is short and thin.

The disk-type mascara brush does not stimulate eyelash much so that feeling in use is superior to the bristle-brush because it is mainly made of a silicon rubber. However, because center of all the plate-tooth are identical to that of the wand and the size of all the plate-tooth is identical, eyelash becomes combed up while the plate-tooth is hardly snuggled into eyelash when combing eyelash up with the mascara brush to which mascara solution is applied, so that not only eyelash cannot be combed well or curled roundly to the tip but also there happens a problem that eyelash clings together.

DISCLOSURE OF INVENTION

Technical Problem

The present invention is designed to solve at least one of those problems. An object of the present invention is to provide a mascara brush capable of minimizing stimulation to eyelash as well as snuggling the plate-tooth of a mascara brush into eyelash easily, so that not only curling of eyelash can be performed easily, eyelash can be arranged in order and a natural eyelash makeup is possible but also productivity is maximized and constant quality can be maintained by forming it whole.

Technical Solution

According to an aspect of the present invention, there is provided of a mascara brush whose brush portion is formed at the end of the wand, wherein the brush portion is formed whole and in such a shape that plate-tooth of triangle-like disks are piled consecutively with an alternated arrangement at the a constant angle like an unfolded fan around a point.

Advantageous Effects

According to the present invention, productivity can be maximized because the brush portion is produced simply by forming it whole, cost can be reduced and consumers credit can be achieved because constant quality can be maintained, stimulation to eyelash can be minimized because it is made of soft and elastic material such as silicon rubber. Further mascara solution can be applied to eyelash so plentiful that eyelash can be shown exuberantly because the brush portion is formed in such a shape that plate-tooth of triangle-like elliptic disks are piled consecutively with an alternated arrangement at an constant angle around a point such that a tooth-indented portion is formed between tooth-protruded portions. In addition, curling of eyelash can be done well, no cling of eyelash exists and natural eyelash makeup can be done because combing is performed as tooth snuggles into eyelash well.

BRIEF DESCRIPTION OF THE DRAWINGS

FIG. 1 shows a front view of a conventional mascara brush;

FIG. 2 shows a front view of the mascara brush according to an embodiment of the present invention;

FIG. 3 shows a side view of the mascara brush according to an embodiment of the present invention;

FIG. 4 shows a plain view of the mascara brush according to an embodiment of the present invention;

FIG. 5 shows a perspective view of the mascara brush according to an embodiment of the present invention;

FIG. 6 shows a vertical sectional view of the mascara brush according to an embodiment of the present invention;

DESCRIPTION OF THE PARTS

10: brush portion 12: plate-tooth
14: tooth-protruded portion 16: tooth-indented portion
17: tooth-spaced portion 18: eyelash curling portion
19: eyelash ordering portion 20: wand
30: mascara cap.

MODE FOR THE INVENTION

The mascara brush of the present invention will now be described in detail taken into drawings accompanied.

Because the accompanied drawings are only an example to show the technical idea of the present invention, and thus it should be understood that the accompanied drawings do not limit the technical idea of the present invention.

FIG. 2 shows a front view of the mascara brush according to an embodiment of the present invention, FIG. 3 shows a side view of the mascara brush according to an embodiment of the present invention, FIG. 4 shows a plain view of the mascara brush according to an embodiment of the present invention, FIG. 5 shows a perspective view of the mascara brush according to an embodiment of the present invention and FIG. 6 shows a vertical sectional view of the mascara brush according to an embodiment of the present invention.

As it is found, a disk-type mascara brush according to the present invention has a brush portion 1 provided at one end of a wand 2, a mascara cap 3 provided at the other end of a wand 2 and the brush portion 1 formed whole at the end of the wand 2. In particular, the brush portion 10 is formed whole and in such a shape that plate-tooth of elliptic disks are piled consecutively with an alternated arrangement at a constant angle (b) around a point (a)

The arranging angle of 120 degree (b) of the plate-tooth 12 is an angle to ensure that the plate-tooth 12 can comb eyelash easily. It is known by experiments that similar effect can be achieved with an arranging angle of 90 degree of the plate-tooth 12. Thus it is preferable that the arranging angle of the plate-tooth 12 is 90 degree or 120 degree.

When the tooth-plate 12 make a shape as like an unfolded fan is unfolded, the constant angle is preferable to be arranged between 5 degree and 45 degree, more preferably, between 10 degree and 30 degree.

The shape of each plate of the plate-tooth 12 which constitutes the brush portion 10 is shown ellipse. The shape is drawn as an asymmetric around the center, as shown in FIG. 4, it is only an example embodiment of the present invention. Thus, of course, not only an asymmetric ellipse but also a symmetric ellipse is available in the present invention. In addition, material of the brush portion 10 can be silicon rubber, rubber, nylon, polyethylene, polypropylene, etc, and more preferably, it is made of silicon rubber.

Because the brush portion 10 has such a shape that the plate-tooth 12 are piled consecutively with an alternated arrangement at the constant angle around the point, the portion where the plate-tooth 12 is protruded makes a tooth-protruded portion 14 and the portion where the plate-tooth 12 is indented makes a tooth-indented portion 16, and tooth-spaced portion 18 is formed between the tooth-protruded portion 14 and the tooth-indented portion 16.

Because the brush portion 10 has such a shape that the plate-tooth 12 are piled consecutively with an alternated arrangement at the constant angle around the point, the tooth-protruded portion 14 and the tooth-indented portion 16 are shown in the front view of the brush portion 10, as shown in FIG. 2. Meanwhile, because the axis of the tooth-plate 12 are pointed in the same line along with the axis of the wand 20 and it is shown that the tooth-plate 20 are arranged in order, the tooth-protruded portion 14 and the tooth-indented portion 16, as shown in the front view, are not shown in the side view of the brush portion 10 and only the tooth-spaced portion 17 exists among the tooth-plate 20, as shown in FIG. 3.

The operation of the mascara brush according to the present invention will now be described.

As described above, because there are the tooth-protruded portion 14 and the tooth-indented portion 16 in the front view and the tooth-spaced portion 17 in the side view, much mascara solution can be applied to the tooth-protruded portion 14 and the tooth-indented portion 16 in the front view whereas few mascara solution can be applied to the tooth-spaced portion 17 between the tooth-protruded portion 14 and the tooth-indented portion 16 in the side view when the mascara brush according to the present invention is taken out after putting it in a mascara container in order to make up eyelash.

When makeup eyelash using the mascara brush according to the present invention, eyelash is curled after applying mascara solution thereto using an eyelash curling portion 18, which is constituted by the tooth-protruded portion 14 and the tooth-indented portion 16 at the front of the brush portion 10, and after then eyelash is arranged in order using an eyelash ordering portion 19, which is constituted by the tooth-spaced portion 17 at the side of the brush portion 10.

Because the eyelash curling portion 18 can snuggled into eyelash because the tooth-protruded portion 14 is protruded, thus even the Eastern people, whose eyelash is short and thin, can make eyelash looked exuberantly and curled easily.

In addition, the tooth-spaced portion 17 with slant between the plate-tooth 12, eyelashes can be combed up while being inserted in the tooth-spaced portion 17 when combing to makeup eyelash, thus effect to curl eyelash is very excellent. It is suitable that the angle (a) of the tooth-spaced portion 17 is ranged between 5 degree and 30 degree, more preferably, between 7 degree and 30 degree. If the angle (a) of the tooth-spaced portion 17 exceeds 30 degree, effect to curl is decreased because eyelash can not be inserted into the tooth-indented portion 18 when combing eyelash.

The invention claimed is:

1. In a disk-type mascara brush where a brush portion 1 is provided at one end of a wand 2, a mascara cap 3 is provided at the other end of a wand 2 and the brush portion 1 is formed in such a shape that disks are piled at the end of the wand 2, the mascara brush is characterized in that:

the brush portion 10 is formed whole and in such a shape that disk-type plate teeth 12 are piled consecutively with an arrangement repeatedly rotated by a constant angle around a point (a), thereby a tooth-protruded portion 14 and a tooth-indented portion 16 exist in the front face of the brush portion 10 whereas only a tooth-spaced portion 17 exists in the side faces the brush portion 10;

wherein the disk-type plate teeth 12 are tapered toward outer perimeter thereof;

wherein adjacent disk-type plate teeth 12 are close enough so that much mascara solution can be applied to the tooth-protruded portion 14 and the tooth-indented portion 16;

wherein slant angle (a) between surfaces of two adjacent disk-type plate teeth 12 is ranged between 5 degree and 30 degree so that eyelashes are inserted into the tooth-spaced portion 17 to be curled; and wherein the angle by which the plate-tooth 12 are unfolded is arranged between 5 degree and 45 degree.

2. The mascara brush of claim 1, wherein the shape of the plate-tooth is asymmetric ellipse or symmetric ellipse.

3. The mascara brush of claim 1, wherein slant angle (a) between surfaces of two adjacent disk-type plate teeth 12 is ranged between 7 degree and 15 degree.

4. The mascara brush of claim 1, wherein the brush portion 10 is made of silicon rubber, nylon, polyethylene or polypropylene.

* * * * *